US011114775B2

(12) United States Patent
Andresen

(10) Patent No.: US 11,114,775 B2
(45) Date of Patent: Sep. 7, 2021

(54) CONTACTING DEVICE FOR CONTACTING A SHIELDING CONDUCTOR OF AN ELECTRICAL LINE WITH A GROUNDING SECTION

(71) Applicant: Phoenix Contact GmbH & Co. KG, Blomberg (DE)

(72) Inventor: Jens Andresen, Blomberg (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 123 days.

(21) Appl. No.: 16/306,906

(22) PCT Filed: Jun. 1, 2017

(86) PCT No.: PCT/EP2017/063393

§ 371 (c)(1),
(2) Date: Dec. 4, 2018

(87) PCT Pub. No.: WO2017/211696

PCT Pub. Date: Dec. 14, 2017

(65) Prior Publication Data

US 2020/0313315 A1 Oct. 1, 2020

(30) Foreign Application Priority Data

Jun. 6, 2016 (DE) ..... 10 2016 110 393.4

(51) Int. Cl.
*H01R 4/48* (2006.01)
*H01R 4/66* (2006.01)

(52) U.S. Cl.
CPC ..... *H01R 4/489* (2013.01); *H01R 4/4836* (2013.01); *H01R 4/66* (2013.01)

(58) Field of Classification Search
CPC .... H01R 4/4818; H01R 4/4827; H01R 11/24; H01R 4/489; H01R 4/4836; H01R 4/66
USPC ..... 439/838, 441
See application file for complete search history.

(56) References Cited

U.S. PATENT DOCUMENTS

| | | | | |
|---|---|---|---|---|
| 5,934,818 | A | 8/1999 | Schmitt et al. | |
| 8,727,819 | B2 * | 5/2014 | Giefers | H01R 11/24 439/838 |
| 2011/0318975 | A1 | 12/2011 | Giefers et al. | |

FOREIGN PATENT DOCUMENTS

| | | | |
|---|---|---|---|
| CN | 204118273 | U | 1/2015 |
| DE | 9217572 | U1 | 2/1993 |
| DE | 19613557 | A1 | 6/1997 |
| DE | 19610854 | A1 | 9/1997 |
| DE | 20014918 | U1 | 5/2001 |

(Continued)

*Primary Examiner* — Gary F Paumen
(74) *Attorney, Agent, or Firm* — Leydig, Voit & Mayer, Ltd.

(57) ABSTRACT

A contacting device for contacting a shielding conductor of an electrical line with a grounding portion includes: a housing which encloses a receptacle space into which the electrical line including the shielding conductor is insertable, the housing being attachable to the grounding portion such that the grounding portion extends in the receptacle space; and a spring element which is arranged on the housing so as to be pivotable about a pivot axis from an open position into a clamping position, in order, in the clamping position, to contact the shielding conductor of the electrical line inserted into the receptacle space with the grounding portion to which the housing is attached.

7 Claims, 2 Drawing Sheets

(56) References Cited

FOREIGN PATENT DOCUMENTS

| | | | |
|---|---|---|---|
| DE | 102007025023 | A1 | 12/2008 |
| DE | 102013107292 | A1 | 1/2015 |
| DE | 202015102037 | U1 | 5/2015 |
| JP | H 10289739 | A | 10/1998 |
| WO | WO 2010066399 | A1 | 6/2010 |

* cited by examiner

CONTACTING DEVICE FOR CONTACTING A SHIELDING CONDUCTOR OF AN ELECTRICAL LINE WITH A GROUNDING SECTION

CROSS-REFERENCE TO PRIOR APPLICATIONS

This application is a U.S. National Phase application under 35 U.S.C. § 371 of International Application No. PCT/EP2017/063393, filed on Jun. 1, 2017, and claims benefit to German Patent Application No. DE 10 2016 110 393.4, filed on Jun. 6, 2016. The International Application was published in German on Dec. 14, 2017 as WO 2017/211696 under PCT Article 21(2).

FIELD

The invention relates to a contacting device for contacting a shielding conductor of an electrical line with a grounding portion.

BACKGROUND

Such a contacting device comprises a housing which encloses a receptacle space into which an electrical line comprising a shielding conductor can be inserted. The housing can be attached to a grounding portion such that the grounding portion extends in the receptacle space.

Such a contacting device, also referred to as a shield terminal, is used to contact a shielding conductor, for example in the form of a braided shield surrounding the line wires of the electrical line, over a wide region with a grounding portion—for example, a busbar or a housing edge of an electrical system (such as a control cabinet). The contact should in this case be resistant, in particular temperature- and corrosion-resistant (even in an aggressive environment), in order to obtain reliable grounding of the shielding conductor with the grounding portion over the operating life of the electrical system.

Conventional contacting devices have a comparatively complex structure, use a plurality of components and are correspondingly expensive to manufacture.

In a shield terminal known from DE 20 2015 102 037 U1, a grounding portion in the form of a metallic conductor and an electrical line can be inserted into a housing. On the housing, a clamping screw is arranged, via which the electrical line can be contacted by clamping with the metallic conductor.

In a connection element known from DE 200 14 918 U1 for connecting a cable shield of a shielding cable to conductor terminals of at least one module, a ledge is preloaded with respect to a housing by spring elements. A shield cable can be electrically contacted via the ledge.

In a terminal arrangement known from DE 196 108 541 A1, a shielding conductor of an electrical line can be attached to spring terminals for electrically contacting a busbar.

SUMMARY

In an embodiment, the present invention provides a contacting device for contacting a shielding conductor of an electrical line with a grounding portion, comprising: a housing which encloses a receptacle space into which the electrical line comprising the shielding conductor is insertable, the housing being attachable to the grounding portion such that the grounding portion extends in the receptacle space; and a spring element which is arranged on the housing so as to be pivotable about a pivot axis from an open position into a clamping position, in order, in the clamping position, to contact the shielding conductor of the electrical line inserted into the receptacle space with the grounding portion to which the housing is attached.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
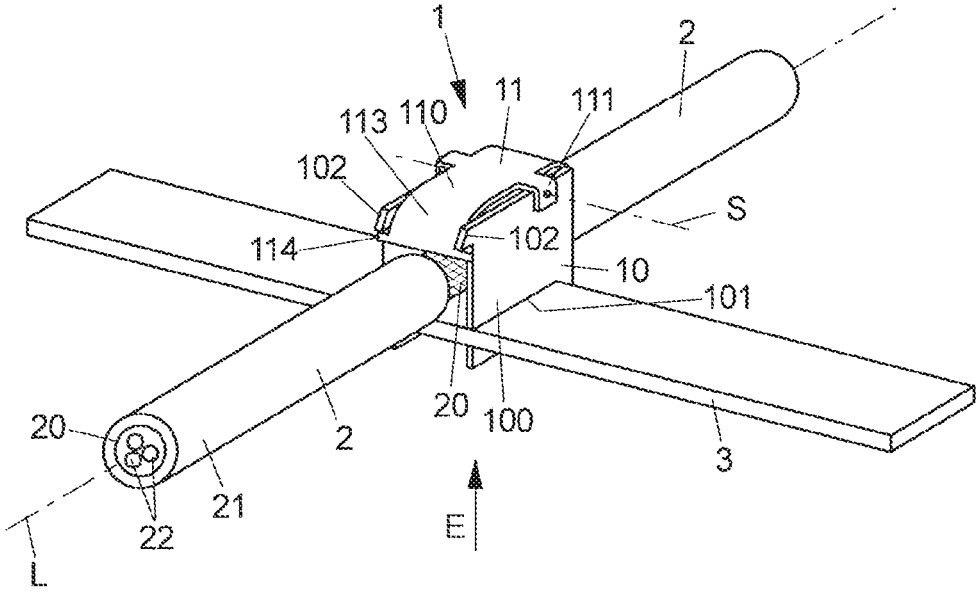
FIG. 1 is a schematic view of a contacting device for electrically contacting a shielding conductor of an electrical line with a grounding portion, for example in the form of an electrical busbar or in the form of a housing edge of an electrical system.

In an embodiment, the present invention provides a contacting device which enables reliable and stable contacting of a shielding conductor of an electrical line with a grounding portion (for example a busbar or a housing edge of an electrical system) while being easy to operate and also being able to be released from a clamping position under certain circumstances.

Accordingly, the contacting device has a spring element which is arranged on the housing so as to be able to pivot about a pivot axis and can be pivoted from an open position into a clamping position in order, in the clamping position, to contact a shielding conductor of an electrical line inserted into the receptacle space with a grounding portion to which the housing is attached.

The contacting device thus has a spring element which is pivotable with respect to the housing and can be moved between an open position and a clamping position. The spring element may for example be made of a spring steel and is thus inherently resilient, so that clamping contact can be established between the shielding conductor and the grounding portion, and for example an aging-related shape change of the shielding conductor or the grounding portion can be compensated for without the contact between the shielding conductor and the grounding portion being impaired.

Due to the fact that the spring element is pivotally mounted on the housing, the spring element is easy to actuate. By pivoting, the spring element can be adjusted in a simple manner between the open position and the clamping position, in order, for example, to contact the shielding conductor with the grounding portion attached to the housing or in turn to release the electrical conductor from the contacting device. The contacting device may be realized with few components. The contacting device may thus be manufactured inexpensively.

For example, the housing and the spring element may be designed as stamped and bent parts.

The spring element may, for example, have an actuating leg pivotally mounted on the housing and a clamping leg which is bent towards the actuating leg and can be brought into clamping abutment with the shielding conductor of the electrical line inserted into the receptacle space. The actuating leg can be latched to the housing to set the position of the spring element relative to the housing in the clamping position. A user can, for example, manually act on the spring element and push the spring element for example in the direction of its clamping position to electrically contact the shielding conductor with the grounding portion. By way of the clamping leg, the spring element thereby comes into clamping abutment with the shielding conductor, so that the shielding conductor is pressed in contact against the grounding portion and electrical contacting is produced between the shielding conductor and the grounding portion.

The clamping leg has, in a specific embodiment, an end edge remote from the actuating leg and an abutment portion which is spaced apart from the end edge and curved about the pivot axis. In this case, in the clamping position, the spring element is designed to come into abutment, by means of the abutment portion, with the shielding conductor of the electrical line inserted into the receptacle space. The fact that the clamping leg does not come into contact with the shielding conductor of the electrical line with its end edge, but via the curved abutment portion which is spaced apart from the end edge, makes it possible to achieve a flat abutment of the clamping leg against the shielding conductor. Due to the curvature of the abutment portion, the clamping leg clings to the shielding conductor and flatly contacts the shielding conductor, without sharp edges coming into contact with the shielding conductor (which could otherwise lead to damage to the shielding conductor).

Latching of the spring element to the housing in the clamping position is preferably brought about by means of the actuating leg. For this purpose, the actuating leg preferably has a latching device which may be formed, for example, by latching lugs on an end portion of the actuating leg remote from the clamping leg. By means of the latching lugs, the actuating leg latches for example with latching projections on the housing such that the actuating leg is interlockingly fixed in its clamping position and thus held in the clamping position.

In order to close the contacting device, the spring element is pressed, for example by pressure on the actuating leg, in the direction of the clamping position. In the clamping position, the spring element jams the shielding conductor of the electrical line to the grounding portion attached to the housing so that the shielding conductor is electrically contacted to the grounding portion. The spring element can be released out of the closed position for example by a user using a tool, such as a screwdriver, to engage a tool engagement feature at the end portion of the actuating leg and, in this way, releasing the latching between the latching lugs of the actuating leg and the latching projections of the housing. When the latching is released, the spring element, due to the resilient bias of the clamping leg (caused by the abutment of the electrical line against the shielding conductor), jumps out of the clamping position, so that the contacting device is opened and the housing can be removed from the grounding portion and the electrical line can be removed from the housing.

The spring element is mounted on the housing so as to be able to pivot about the pivot axis. For the pivotable mounting, two opposing joint plates may be formed on the actuating leg, which protrude from the actuating leg and engage, for example, with joint pins arranged on the housing, so that the spring element is hingedly connected to the housing.

The housing may be formed integrally, for example. In one embodiment, the housing may for example have two parallel side walls which are mutually spaced in a transverse direction and between which the receptacle space is formed, and a base which interconnects the side walls. The housing may thus have a U-shape in cross section, into which shape the electrical line may be inserted with the stripped shielding conductor.

By way of example, the shielding conductor can be inserted into the housing such that the shielding conductor extends in the clamping position along a longitudinal axis between the side walls through the receptacle space. The shielding conductor can in this case, for example, be inserted into the receptacle space in an insertion direction transversely to the longitudinal axis and transversely to the transverse direction in which the side walls are mutually spaced. Thus, the electrical line does not have to be threaded through the housing, but can be easily inserted into the housing in the direction of insertion so that the shielding conductor comes to rest in the receptacle space of the housing.

For electrically contacting the shielding conductor of the electrical line with a grounding portion, the electrical line comprising the stripped shielding conductor is preferably first inserted into the housing of the contacting device. Then, the housing together with the electrical line arranged thereon can be attached to the grounding portion, for example, a grounding busbar or a portion of a housing wall of an electrical system, such as a control cabinet or the like. If the housing has been attached to the grounding portion, the grounding portion preferably extends through the receptacle space in the transverse direction in which the side walls of the housing are mutually spaced. For this purpose, the side walls of the housing may have recesses of which the shape is adapted to the shape of the grounding portion and which can thus receive the grounding portion, for example a metallic conductor that is rectangular in cross section.

The electrical line and the grounding portion thus extend in different directions with respect to the housing. While the electrical line is laid along the longitudinal axis through the housing, the grounding portion extends transversely to the electrical line in the transverse direction through the receptacle space.

In so doing, the spring element on the one hand and the grounding portion on the other hand of the insulated shielding conductor of the electrical line preferably come to rest in the clamping position. The shielding conductor is thus received between the spring element and the grounding portion and pressed, by clamping abutment of the spring element against the shielding conductor, into direct, electrically contacting abutment with the grounding portion.

In the context of the invention, it is possible to form a shielding conductor in different ways. In the context of the invention, therefore, the shielding conductor may also be formed by means of a line wire, which in turn also serves as a protective conductor, for example for grounding protection. Therefore, a contacting device according to the invention also comprises contacting a line wire of an electrical line. The contacting of the line wire by means of a contacting device according to the invention is carried out in an analogous manner to the contacting of a shielding conductor, as described above and explained with reference to the following exemplary embodiments.

FIG. 1 is a schematic view of a contacting device 1 which is used to electrically contact a shielding conductor 20 in the form of an electrically conductive braided shield of an electrical line 2.

The electrical line 2 has, for example, a plurality of electrical line wires 22, which are surrounded by the shielding conductor 20 in the form of the braided shield. In this case, the shielding conductor 20 is enveloped towards the outside by means of an electrically insulating sheath, so that the shielding conductor 20 is insulated toward the outside.

By means of the contacting device 1, the shielding conductor 20 of the electrical line 2 can be electrically contacted with a grounding portion 3 in the form of a metallic conductor, for example a busbar or a housing edge of an electrical system. As a result, the shielding conductor 20 can be brought to the grounding potential of the grounding portion 3 so that grounding of the shielding conductor 20 is provided via the contacting device 1. In principle, a plurality of electrical lines 2 may be arranged and electrically grounded at the grounding portion 3.

Figure 2:
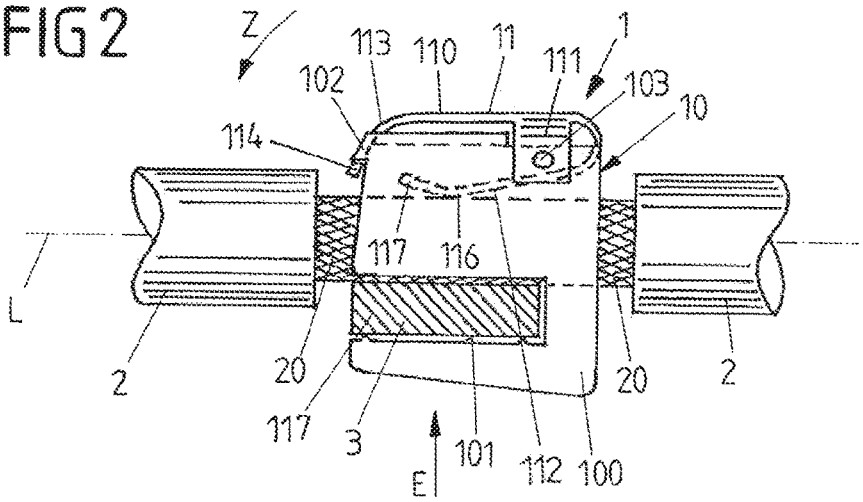
FIG. 2 is a side view of the contacting device.
Figure 3:
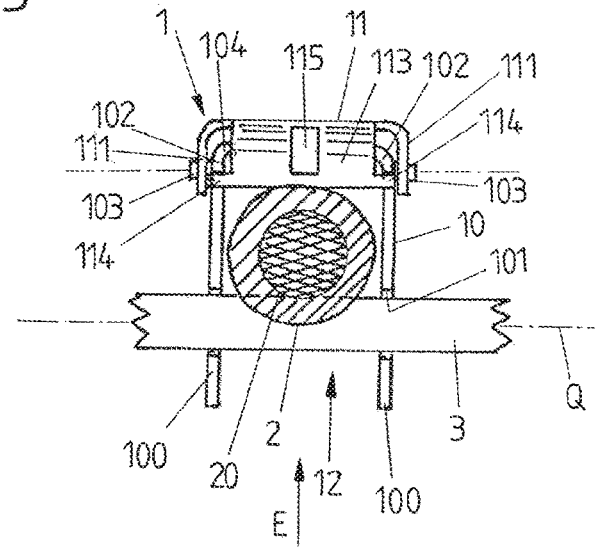
FIG. 3 is a front view of the contacting device.
Figure 4:
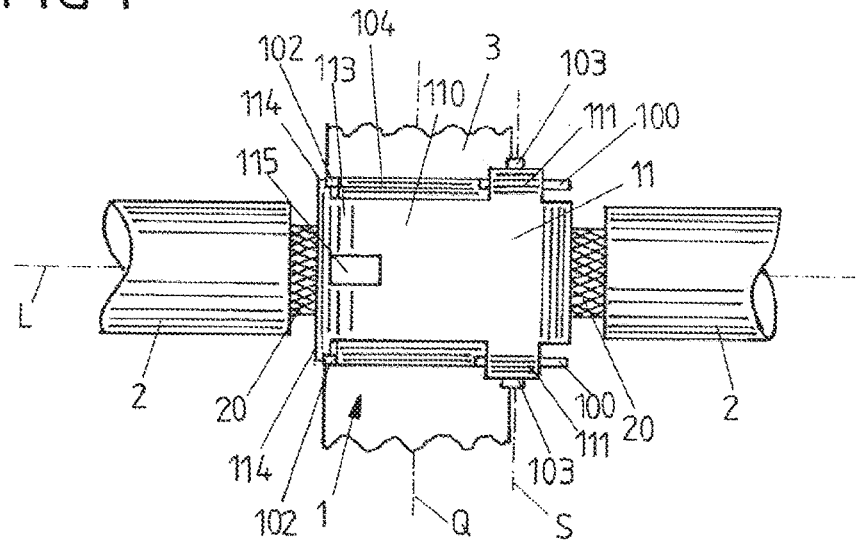
FIG. 4 is a plan view of the contacting device.

In the embodiment shown, the contacting device 1, as shown in the views of FIGS. 2 to 4, has a housing 10 which is formed of two parallel side walls 100 which are mutually spaced in a transverse direction Q and a base 104 which interconnects the side walls 100. The housing 10 is preferably made in one piece, for example as stamped and bent sheet metal parts.

On the housing 100, a spring element 11 is arranged which is pivotable about a pivot axis S, and which has an actuating leg 110 and a clamping leg 112 which is bent towards the actuating leg 110. The spring element 11 is for example made of a stamped and bent part made of spring steel and is inherently resilient, so that the position of the actuating leg 110 and the clamping leg 112 can be resiliently adjusted.

FIGS. 2 to 4 show the spring element 11 in a clamping position in which the spring element 11 is in clamping abutment with the partially stripped shielding conductor 20 of the electrical line 2 and presses the shielding conductor 20 into electrically contacting abutment with the grounding portion 3 which extends through the housing 10. In this clamping position, the spring element 11 is latched via latching lugs 114 at an end portion 113 of the actuating leg 110 remote from the clamping leg 112 with latching projections 102 on the opposing side walls 100, so that the spring element 11 is interlockingly held in its clamping position relative to the housing 10.

In this clamping position, the clamping leg 112 abuts the shielding conductor 20 of the electrical line 2 by means of an abutment portion 116 that is spaced apart from an end edge 117. In the region of this abutment portion 116, the clamping leg 112 is curved (in the plane perpendicular to the pivot axis S) so that no sharp-edged regions of the clamping leg 112 (in particular not the end edge 117) abut the shielding conductor 20, and thus a flat abutment of the clamping leg 112 against the shielding conductor 20 is provided.

In the clamping position, the clamping leg 112 is resilient biased with respect to the actuating leg 110, in that the spring element 11 is pressed into the clamping position and is latched to the housing 10 by means of the actuating leg 110 in this clamping position. Due to the resilience of the spring element 11, for example, a (aging-related) yielding of the shielding conductor 20 of the electrical line 2 can be compensated for without the electrical contacting of the shielding conductor 20 with the grounding portion 3 being impaired by the yielding.

The spring element 11 has, on the actuating leg 110, two opposing joint plates 111 which are each hingedly connected to one of the side walls 100 of the housing 10 and are hingedly arranged on joint pins 103 of the side walls 100 for this purpose. The spring element 11 is thus pivotable about the joint pins 103 and can be adjusted in particular between an open position in which the spring element 11 is opened out of the clamping position counter to a closing direction Z, and the clamping position.

On the side walls 100 of the housing 10, opposing recesses 101 are formed in which the grounding portion 3 can be received such that the grounding portion 3, in a position attached to the housing 10, extends in the transverse direction Q through a receptacle space 12 of the housing 10 formed between the side walls 100, as can be seen for example in FIG. 3.

In contrast, the electrical line 2 can be inserted into the receptacle space 12 with the partially stripped shielding conductor 20 in an insertion direction E from a side remote from the base 104 of the housing 10, so that the electrical line 2, in the inserted position, extends along a longitudinal axis L transversely to the transverse direction Q and transversely to the insertion direction E through the receptacle space 12 of the housing 10.

For the electrical contacting of the shielding conductor 20 of the electrical line 2 with the grounding portion 3, the electrical line 2 comprising the partially stripped shielding conductor 20 is first inserted into the receptacle space 12 in the insertion direction E. Here, the spring element 11 is in its open position, in which the spring element 11 is moved out of the clamping position counter to the closing direction Z.

Then, the contacting device 1 is attached, together with the electrical line 2 arranged thereon, to the grounding portion 3, in that the housing 10 is brought into engagement with the grounding portion 3 via the recesses 101. The grounding portion 3 thus extends through the receptacle space 12 of the housing 10 such that the spring element 11 and the grounding portion 3 come to rest on different sides of the electrical line 2.

Now, by pressing on the actuating leg 110, the spring element 11 is transferred to the clamping position shown in FIGS. 2 to 4 and pressed in the closing direction Z until the actuating leg 110 latches via its latching lugs 114 arranged on the end portion 113 with the latching projections 102 on the side walls 100 of the housing 10. In this way, the clamping leg comes into clamping contact with the shielding conductor 20 and is resiliently tensioned, so that the shielding conductor 20 is pressed into contacting abutment with the grounding portion 3 with a sufficient contact force.

If the electrical line 2 has to be removed from the grounding portion 3, then a user can use a suitable tool, such as a screwdriver, to engage a tool engagement feature 115 in the form of an opening in the end portion 113 of the actuating leg 110, in order to thus release the latching between the actuating leg 110 and the housing 10 by (resilient) bending of the end portion 113. Due to the bias of the clamping leg 112, the spring element 11 jumps out of its clamping position, so that the contacting device 1 is opened and the housing 10 can be removed from the grounding portion 3 and the electrical line 2 can be removed from the housing 10.

The concept underlying the invention is not limited to the embodiments described above, but may also be realized in a completely different way.

The provided contacting device may have a simple construction and use only a few components. In particular, the contacting device may in principle be produced by using a housing part and a spring element; other components may be omitted. This results in a simple, cost-effective production with a compact design.

The contacting device can also provide a favorable, reliable, stable contact force for electrically contacting a shielding conductor with a grounding portion. The contacting device may be simple and intuitive to use and also allow contacting to be released.

The contacting device may in principle also be designed differently than described herein. For example, the housing may have a different shape.

The housing may preferably be made of metal, for example as a stamped and bent part, but this is not necessary. In principle, it is also conceivable and possible to form the housing from plastics material.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SIGNS

1 contacting device
10 housing
100 side walls
101 recess
102 latching projection
103 joint pin
104 base
11 spring element
110 actuating leg
111 joint plate
112 clamping leg
113 end portion
114 latching lugs
115 tool engagement feature
116 abutment portion
117 end edge
12 receptacle space
2 line
20 shielding conductor
21 sheath
22 line wires
3 grounding portion
E insertion direction
L longitudinal axis
S pivot axis
Z closing direction

The invention claimed is:

1. A contacting device for contacting a shielding conductor of an electrical line with a grounding portion, comprising:

a housing which encloses a receptacle space into which the electrical line comprising the shielding conductor is insertable, the housing being attachable to the grounding portion such that the grounding portion extends in the receptacle space; and a spring element which is arranged on the housing so as to be pivotable about a pivot axis from an open position into a clamping position, in order, in the clamping position, to contact the shielding conductor of the electrical line inserted into the receptacle space with the grounding portion to which the housing is attached, wherein the spring element has an actuating leg which is pivotally mounted on the housing, and a clamping leg which is bent towards the actuating leg and is configured to be brought into clamping abutment with the shielding conductor of the electrical line inserted into the receptacle space, wherein the actuating leg has at least one latching leg at an end portion remote from the clamping leg configured to provide a latching connection to at least one latching projection of the housing in the clamping position, wherein the contacting device further comprises a tool engagement feature arranged at the end portion of the actuating leg, the tool engagement feature being configured to release the spring element from the clamping position, wherein the housing has two parallel side walls which are mutually spaced in a transverse direction and between which the receptacle space is formed, and a base which interconnects the side walls, wherein the shielding conductor of the electrical line is insertable into the housing such that the shielding conductor extends along a longitudinal axis between the side walls through the receptacle space, and wherein the shielding conductor of the electrical line is insertable into the receptacle space in an insertion direction transversely to the longitudinal axis and transversely to the transverse direction.

2. The contacting device according to claim 1, wherein the clamping leg has an end edge remote from the actuating leg, and an abutment portion which is spaced apart from the end edge and curved about the pivot axis, and wherein, in the clamping position, the spring element is configured to come into abutment, by the abutment portion, with the shielding conductor of the electrical line inserted into the receptacle space.

3. The contacting device according to claim 1, further comprising at least one joint plate pivotably connectable to the housing, the at least one joint plate protruding from the actuating leg.

4. The contacting device according to claim 1, wherein the housing is attachable to the grounding portion such that the grounding portion extends in the transverse direction through the receptacle space.

5. The contacting device according to claim 1, wherein the side walls have recesses configured to receive the grounding portion.

6. The contacting device according to claim 1, wherein the contacting device is configured to receive the shielding conductor of the electrical line in the clamping position between the spring element and the grounding portion.

7. An assembly, comprising:

an electrical line having a shielding conductor;

a grounding portion; and the contacting device according to claim 1.

* * * * *